US005394894A

United States Patent [19]

Zade

[11] Patent Number: 5,394,894

[45] Date of Patent: Mar. 7, 1995

[54] METHOD AND APPARATUS FOR ELIMINATION OF SMOKING

[76] Inventor: Ismail Y. Zade, 25 Larissa La., Thornwood, N.Y. 10548

[21] Appl. No.: 199,752

[22] Filed: Feb. 22, 1994

[51] Int. Cl.[6] ..... A24F 13/18

[52] U.S. Cl. ..... 131/270; 131/349; 131/356

[58] Field of Search ..... 131/349, 329, 235.1, 131/256, 270; 138/148, 149

[56] References Cited

U.S. PATENT DOCUMENTS

| | | | |
|---|---|---|---|
| 1,863,000 | 6/1932 | Barnes | 131/349 X |
| 2,965,107 | 12/1960 | Lehu | 131/256 |
| 3,091,243 | 5/1963 | Guida | 131/256 X |
| 4,319,587 | 3/1982 | Moser | 131/349 X |
| 4,410,013 | 10/1983 | Sasaki | 138/148 X |
| 4,638,819 | 1/1987 | Ikeda | 131/349 X |
| 4,979,522 | 12/1990 | Kishida | 131/349 |
| 5,253,680 | 10/1993 | Matsumoto | 138/148 |

FOREIGN PATENT DOCUMENTS

| | | | |
|---|---|---|---|
| 2556184 | 6/1985 | France | 131/256 |

*Primary Examiner*—Jennifer Bahr

*Attorney, Agent, or Firm*—Martin J. Spellman, Jr.

[57] ABSTRACT

A smoking inhibitor ring for placement on a cigarette to limit the length of available cigarette to smoke has concentric aluminum cylindrical, uniformly spaced apart inner and outer walls joined at each end by closures, the insulation space between the inner and outer walls being unfilled and the inner wall having an inner diameter substantially the same as a cigarette. A method of using the inhibitor ring includes placing one and then increasing numbers of the rings on a cigarette to gradually decrease the length of cigarette available to smoke.

3 Claims, 1 Drawing Sheet

METHOD AND APPARATUS FOR ELIMINATION OF SMOKING

BACKGROUND OF THE INVENTION

1. Field of the Invention

This invention is concerned with an apparatus and method to assist people to effectively quit smoking. By using this method of the ring, it is a "step by step" method. The ring will be made of aluminum or available heat resistant material, i.e.; kevlar. The ring has two (2) lines, the distance between them is ½ or 1 millimeter. This space will be airless for reducing the heat from the cigarette to the surface sheath. This invention provides a means for gradually cutting down the amount of cigarette(s) available for the smoker to use at any one time, as well as weaning the smoker off of the addicting nicotine without inducing the usually encountered withdrawal symptoms such as restlessness, amnesia, lethargy, impaired concentration and judgement, diminished pulse rate, coughing, constipation, tiredness, nervousness, disorientation, irritability, anxiety, sleeplessness, and the craving to smoke as well. It is undisputed that nicotine is addictive, some studies indicate that 85% of those who smoke even one cigarette, are hooked on the habit of smoking. It is also beyond dispute that smoking is damaging to the health as well as being fatal in the long term for most smokers.

The gases and particles in smokers which enter the mouth at up to around 880 centigrade, comprise a concentrated aerosol with billions of tiny particles all less than 2 microns in diameter, with tar as well as nicotine. These gases include formaldehyde, acetaldehyde, acrolein, methanol, acetone, ketone, methyllethyl, ammonia, nitrogendioxide, carbon dioxide, and hydrogen sulfide. These are irritants to lung tissue, a cigarette consists of more than 4,000 chemical substances of which 43 of those are known to cause or promote cancer. Those who smoke have their lives cut shorter significantly by coronary heart disease and lung cancer, as compared to those who don't smoke. Damage to the body depends on the number of cigarettes smoked, number of inhalations in volume, duration and depth of inhalation puff interval, mechanical correlates of smoking such as butt weight and length of the cigarette. The most harmful substances are tar and nicotine, which are highly toxic. It increases the number of cancers of the larynx, pancreas, bladder, kidney, and cervix and also causes coronary heart disease. It increases still birth, neonatal death, prematurity, low birth weight, and fetal death.

Hospital admissions for bronchitis and pneumonia are twice as high for children whose parents smoke. They also have an increased risk of cancer later in life. Cigarette smoking and breast feeding are not compatible. Cigarette smoking may reduce milk production, decrease vitamin "C" content of the milk, and increase colicky pain and diarrhea in the baby.

Smoking is responsible for one death in four in the United States—about 400,000 lives per year, mostly from lung cancer and coronary heart disease. The cost in lives, money and suffering are enormous. Yet logically, smoking is the most preventable cause of death in our society, one must only stop smoking.

If a smoker stops smoking after 10 to 15 years, the risk of lung cancer approaches that of those who never smoked, but the risk of coronary heart disease decreases after one year.

2. Prior Art

Since the 16th century, humans knew that smoking has had ill effects. But not until 1859, was the first scientific proof presented. In 1936, people became more aware of the health hazards of smoking, the use of filters expanded in attempts to remove some of the tar and other pollutants. Studies showed, however that filtered cigarettes could actually be more harmful to a smoker's health than non filters.

The research showed that filter tipped cigarettes have a higher rate of heart stroke than nonfiltered cigarettes. Most significantly various filters and holders don't solve the problem of the smoking and the addiction to nicotine. Studies show that in 1991, children, especially girls are starting to smoke at an early age, more than 3,000 teenagers become regular smokers each day in the United States. The present invention as will be seen, weans the addicted smoker from smoking by mechanically and progressively eliminating the useful amount of each smoking unit, i.e. cigarettes or cigars available for use by the addicted victim. There are no known similar approaches to eliminating the use of smoking tobacco. There are many methods for quitting cigarettes, such as psychotherapy, psychoanalysis, hypnotism, acupuncture, cigarette holders, oral local anesthetics, nicotine gum. All have been used, all with varying degrees of success. The most popular kind is nicorette gum (nicotine gum). It also has it's problems, such as it can only be obtained with a physician's prescription. Each box of Nicorette has 96 chewing pieces, smokers have to take between 10–30 pieces a day for one to three months.

During the course of treatment, smokers have to visit their doctor several times. It is very expensive system to quit this way, also it's not convenient. The nicotine gum also has an unpleasant taste. This therapy shouldn't be used in patients who have active ulcers, temporomindibuler joint disease, cardiac arrhythmias, angina, or by pregnant or lactating women. The most common problem, is the continuation of smoking while using this type of treatment. Each tablet has 2 mg. of nicotine, which 90% of nicotine releases in 2 minutes after using. The nicotine goes to the brain within seven seconds and the gum doesn't reduce the desire for nicotine. Nicotine at first stimulates the brain, then it paralyzes the skeletal muscles as well as the central nervous system. The nicotine may cause: insomnia, excess salivation, dizziness, headache, irritability, eructation, indigestion, nausea, vomiting, and hiccups.

A popular product is called "Habitrol" transdermal patch. The Habitrol patch is the same as Nicorette, but contains more nicotine and supplies the nicotine to the blood stream continuously. This product requires a doctor's prescription to obtain. The side effect of Habitrol is the same as Nicorette, plus local application site reactions, more than 35% erythema, pruritus, and burning. It is a very expensive and lengthy method.

In U.S. Pat. No. 3,455,101, a mechanical clock operated cigarette container which permits the removal of a cigarette at predetermined time intervals is disclosed as a means of eliminating smoking. A problem that exists in this type of invention is that a smoker doesn't have time regulation. For example, a smoker might not smoke for hours or sometimes it's possible that they could smoke more cigarettes per hour than what is permitted. Many variables can determine or affect a smoker's desire to smoke, such as: personal mood, place, the time of day, food or drink, and also the addiction to nicotine which a smoker usually can't or has difficulty resisting. These variables all make time interval control difficult.

SUMMARY OF THE INVENTION

The present invention provides a method and apparatus to assist addicted smokers in eliminating this unhealthy practice.

According to the present invention, a series of annular rings preferably about 5 millimeters in length and having an inner diameter substantially the same as a cigarette are progressively added over a period of time to the external surfaces of a cigarette starting at the unlit end to effectively cut down progressively on the length of cigarette available to smoke. The rings at first eliminate 5 millimeters and then add a ring at a time until up to 10 rings or 50 millimeters of ring length is used substantially eliminating the useful length of cigarette and thereby gradually eliminating the addiction to nicotine and the consequent deadly practice of smoking. In an alternative embodiment, the invention is adapted to a cigarette holder including a mouth piece, an intervening tube to hold a filter, and then the ring covers as in the first versions.

The same type apparatus is used to eliminate cigar smoking. Needed diameter variations to adjust to the available cigarette and cigar sizes is not extensive.

The rings are preferably double walled. They have an inside wall dimensioned to fit over the cigarette and a spaced apart outer concentric wall that is held by the smoker. The ends of the walls are joined to form an insulation space between them. The gap between the walls is generally ½ or 1 milliliters.

BRIEF DESCRIPTION OF THE DRAWING

In the accompanying drawing which form a part of the specification.

DESCRIPTION OF THE ILLUSTRATIVE EMBODIMENT

Figure 1:
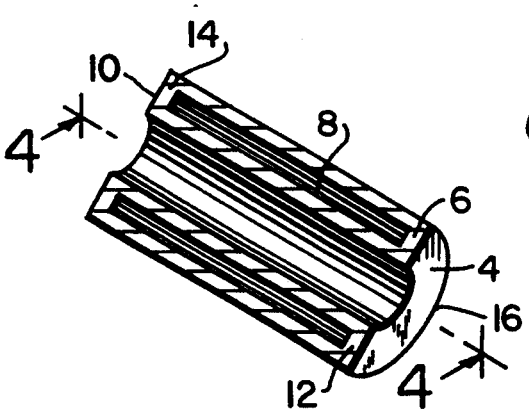
FIG. 1 is a perspective sectional view of one of the rings.
Figure 2:
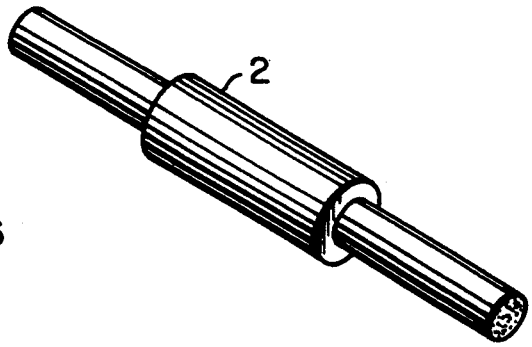
FIG. 2 shows the ring of FIG. 1 on a lit cigarette.
Figure 3:
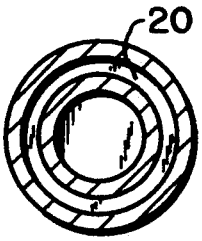
FIG. 3 is a sectional view of the ring along lines 3—3 of FIG. 4.
Figure 4:
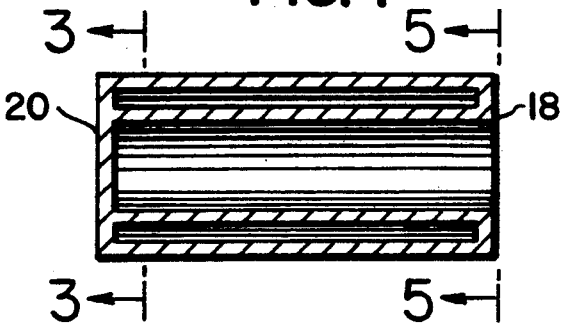
FIG. 4 is a sectional view of the ring along lines 4—4 of FIG. 1.
Figure 5:
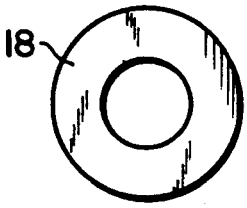
FIG. 5 is a plan view along lines 5—5 of FIG. 4.
Figure 6:
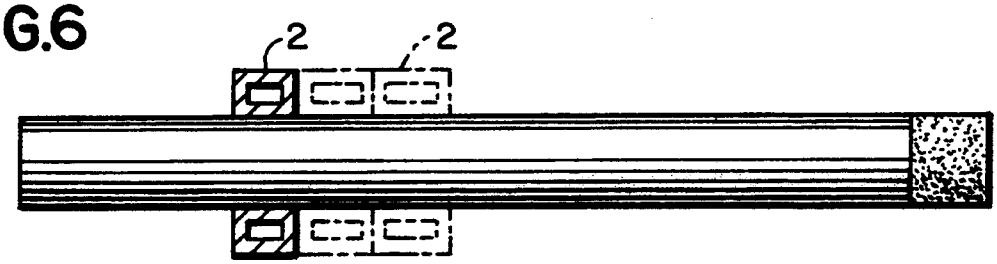
FIG. 6 is a side view partially in section showing rings added to a cigarette.

In the accompanying drawing, one of the rings 2 of the present invention is shown in cross section and comprises an inner wall 4 and an outer wall 6. The space 8 between the walls 4 and 6 is approximately ½ or 1 millimeter thick and serves to insulate the outer wall 6 from transfer of heat from the cigarette. The ends 10 and 12 of wall 4 and the ends 14 and 16 of walls 6 are joined together respectively by end closures 18 and 20. The walls 4 and 6 and closures 18 and 20 are made of tin-aluminum sheet.

The smoking is tapered off by the user initially placing a 5 millimeter ring adjacent to the end cigarette, before the filter that goes in the smoker's mouth. Only about 5 millimeters of smokable length is eliminated.

Figure 7:
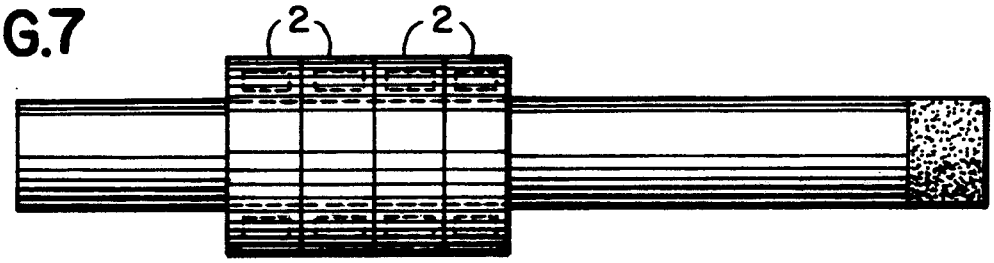
FIG. 7 shows additional rings on the cigarette.
Figure 8:
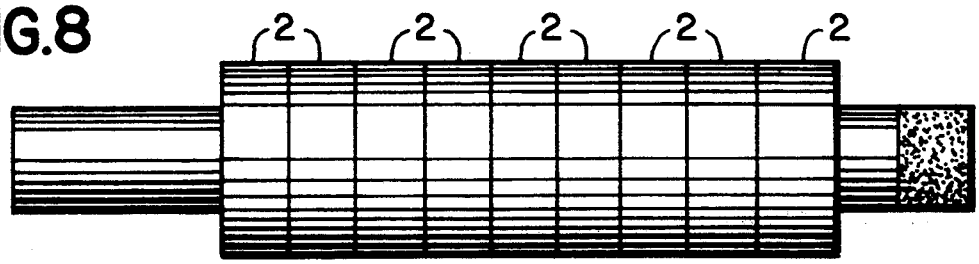
FIG. 8 shows rings almost the entire length of the cigarette virtually eliminating the available length for smoking.

The smoker smokes as usual, but there is less cigarette available. Additional rings are added one at a time (FIG. 7–8) in weekly steps and thus the available cigarette is gradually reduced to 0, thus gradually but in a fixed controlled manner the user is weaned off of cigarettes and/or cigars and the addiction successfully eliminated.

While the invention has been described by reference to an illustrative embodiment, it's not intended that the novel device be limited thereby, but that modifications thereof are intended to be included as falling within the broad spirit and scope of the foregoing disclosure, the following claims and the appended drawings. The ring is generally made in different caliber sizes, to use in the nonfiltered cigarette and different sizes of the cigar.

What is claimed is:

1. A smoking inhibitor ring comprising concentric aluminum cylindrical uniformally spaced apart inner and outer walls, each of said inner and outer walls having a first end and a second end, said first ends joined by a closure and said second ends joined by a second closure to define an insulation space, said insulation space being unfilled and said inner wall having an inner diameter substantially the same as a cigarette.

2. A smoking inhibitor ring is claimed in claim 1 wherein the distance between said inner and outer walls is from ½ to 1 millimeter, and wherein said ring is about five millimeters in length.

3. A method of decreasing in sequential steps the available length of each cigarette smoked by a user comprising initially placing a single smoking inhibitor ring comprising concentric aluminum cylindrical spaced apart inner and outer walls, each of said inner and outer walls having a first end and a second end, said first ends joined by a closure and said second ends joined by a second closure to define an insulation space, on a cigarette, thereafter in steps, adding increasing numbers of such rings to subsequent cigarettes smoked by said user until the length of available cigarette to smoke is substantially eliminated.

* * * * *